US008051926B2

(12) United States Patent
Weddfelt

(10) Patent No.: US 8,051,926 B2
(45) Date of Patent: Nov. 8, 2011

(54) CONTROL DEVICE

(75) Inventor: Kenneth Weddfelt, Stora Mellösa (SE)

(73) Assignee: Atlas Copco Rock Drills AB, Orebro (SE)

( * ) Notice: Subject to any disclaimer, the term of this patent is extended or adjusted under 35 U.S.C. 154(b) by 217 days.

(21) Appl. No.: 11/919,566

(22) PCT Filed: May 19, 2006

(86) PCT No.: PCT/SE2006/000580

§ 371 (c)(1), (2), (4) Date: Oct. 30, 2007

(87) PCT Pub. No.: WO2006/126932

PCT Pub. Date: Nov. 30, 2006

(65) Prior Publication Data

US 2009/0032305 A1 Feb. 5, 2009

(30) Foreign Application Priority Data

May 23, 2005 (SE) ..... 0501149

(51) Int. Cl.
*E21B 4/00* (2006.01)

(52) U.S. Cl. ..... 175/293; 175/296; 173/206; 173/207

(58) Field of Classification Search ..... 175/293, 175/296, 297, 19; 173/206, 207, 2, 1
See application file for complete search history.

(56) References Cited

U.S. PATENT DOCUMENTS

| | | | | |
|---|---|---|---|---|
| 3,605,555 | A | 9/1971 | Wise | |
| RE28,768 | E * | 4/1976 | Mason | 175/297 |
| 4,159,039 | A | 6/1979 | Kasuga et al. | |
| 5,222,425 | A | 6/1993 | Davies | |
| 5,549,252 | A | 8/1996 | Walter | |
| 6,112,832 | A | 9/2000 | Muuttonen et al. | |
| 7,013,996 | B2 * | 3/2006 | Keskiniva et al. | 175/135 |
| 7,178,447 | B2 * | 2/2007 | Koskimaki et al. | 91/7 |
| 2004/0226752 | A1 | 11/2004 | Keskiniva et al. | |
| 2006/0032649 | A1 * | 2/2006 | Keskiniva et al. | 173/213 |

FOREIGN PATENT DOCUMENTS

| | | |
|---|---|---|
| GB | 329921 | 5/1930 |
| GB | 1142172 | 2/1969 |
| GB | 2047794 | 12/1980 |
| WO | 96/19323 | 6/1996 |
| WO | 03/004822 | 1/2003 |
| WO | 03/033873 | 4/2003 |
| WO | 03/095153 | 11/2003 |
| WO | 2004/073930 | 9/2004 |
| WO | 2004/073931 | 9/2004 |
| WO | 2004/073932 | 9/2004 |
| WO | 2004/073933 | 9/2004 |
| WO | 2005/002801 | 1/2005 |
| WO | 2005/002802 | 1/2005 |
| WO | 2005/080051 | 9/2005 |

* cited by examiner

*Primary Examiner* — Kenneth L Thompson
*Assistant Examiner* — Sean Andrish
(74) *Attorney, Agent, or Firm* — Mark P. Stone

(57) ABSTRACT

The present invention relates to a control device for an impulse-generating device for inducing a shock wave in a tool, in which said impulse-generating device comprises an impact element for transmitting said shock wave to said tool, a counter pressure chamber acting against the impact element and a device for reducing a pressure in the counter-pressure chamber. The control device comprises control means for regulating the reduction of the pressure in said computer-pressure chamber. The invention also relates to an impulse-generating device.

19 Claims, 7 Drawing Sheets

CONTROL DEVICE

FIELD OF THE INVENTION

The present invention relates to a device and a method for controlling an impulse-generating device for drilling in rock. The invention also relates to an impulse-generating device.

BACKGROUND OF THE INVENTION

In rock drilling, a drilling tool is used that is connected to a rock-drilling device via one or more drill string components. The drilling can be carried out in several ways, a common method being percussive drilling where an impulse-generating device, a striking tool, is used to generate impacts by means of an impact piston that moves forward and backward. The impact piston strikes the drill string, usually via a drill shank, in order to transfer impact pulses to the drilling tool via the drill string, and then on to the rock to deliver the energy of the shock wave. The impact piston is typically driven hydraulically or pneumatically, but can also be driven by other means, such as by electricity or some form of combustion.

Impulse-generating devices in which the shock wave is generated by an impact piston have the problem that the forward and backward movement of the impact piston results in dynamic acceleration forces that have an adverse effect on the impulse-generating device (the striking tool), and thereby the whole rock-drilling device. In percussive drilling, a feed force is used to press the rock-drilling device, and thereby the drill string and drilling tool, against the rock in front of it, in order to avoid the harmful reflections that can arise if the drilling tool is not in contact with the rock at the time of the impact. An impact piston that is accelerated in the direction of the impact gives rise, however, to counter forces in the opposite direction that act to move the rock-drilling equipment in a backward direction, away from the rock. These opposing forces mean that an increased feed pressure is required and that the drilling equipment must therefore be dimensioned for these larger forces, with the result that equipment is obtained that is larger and more expensive overall than is required by the actual shock wave energy.

In an attempt to reduce the problem of the acceleration forces of the impact piston, impulse-generating devices have been produced in which the shock wave energy is not transferred by a piston that moves forward and backward, but instead by pre-loading an impact element by means of a counter-pressure chamber, whereby pressure impulses are transferred to the drill string by means of the impact element by a sudden reduction in the pressure in the counter-pressure chamber.

According to the currently known technology, this solution generates shock waves with lower energy, and, in order to maintain the efficiency of the drilling, the lower energy in each shock wave is compensated for by the shock waves being generated at a higher frequency.

A remaining problem with the abovementioned striking tool that does not have an impact piston is, however, that a part of the impact energy is reflected and returned to the impulse-generating device as harmful energy.

OBJECTS OF THE INVENTION AND MOST IMPORTANT CHARACTERISTICS

An object of the present invention is to provide a control device for an impulse-generating device that solves the abovementioned problem.

Another object of the present invention is to provide a method for an impulse-generating device that solves the abovementioned problem.

These and other objects are achieved according to the present invention by means of a control device as defined in Claim 1 and by a method as claimed in Claim 16.

According to the present invention, a control device is provided for an impulse-generating device for inducing a shock wave in a tool, with said impulse-generating device comprising an impact element for transmitting said shock wave to said tool, a counter-pressure chamber acting against the impact element and a device for reducing the pressure in the counter-pressure chamber. The control device comprises means for controlling the reduction in pressure in said counter-pressure chamber. This has the advantage that the rise time and/or duration of the shock wave can be controlled on the basis of the characteristics of the drilled material so that a larger part of the shock wave energy can be taken up by the drilled material with reduced reflections as a result.

The means for reducing pressure can include a control valve for connection to said counter-pressure chamber, with the control valve comprising at least one opening for controlling said reduction in pressure by the release of the pressure medium contained in the counter-pressure chamber during operation. The reduction in pressure can be controlled by controlling the opening of the control valve. For example, the control valve can be designed with pressure-reducing notches for controlling the reduction in pressure. This has the advantage that the reduction in pressure can be controlled in a simple way.

The counter-pressure chamber can comprise a plurality of outlets, with said outlets being able to be opened in a controlled way. The outlets can have different diameters. This is so that the reduction in pressure can be controlled in a simple way by the opening and closing of the appropriate outlets.

The outlets can be connected to one or more reservoirs by means of one or more flow paths, which said reservoirs can be pressurized during operation to different pressures, whereby a stepped and/or continual reduction in pressure in the counter-pressure chamber can be obtained by opening said outlets. This has the advantage that the reduction in pressure can be achieved without the loss of energy that is associated with control by means of throttles.

The invention also relates to an impulse-generating device according to Claim 12.

DETAILED DESCRIPTION OF PREFERRED EMBODIMENTS

Figure 1:
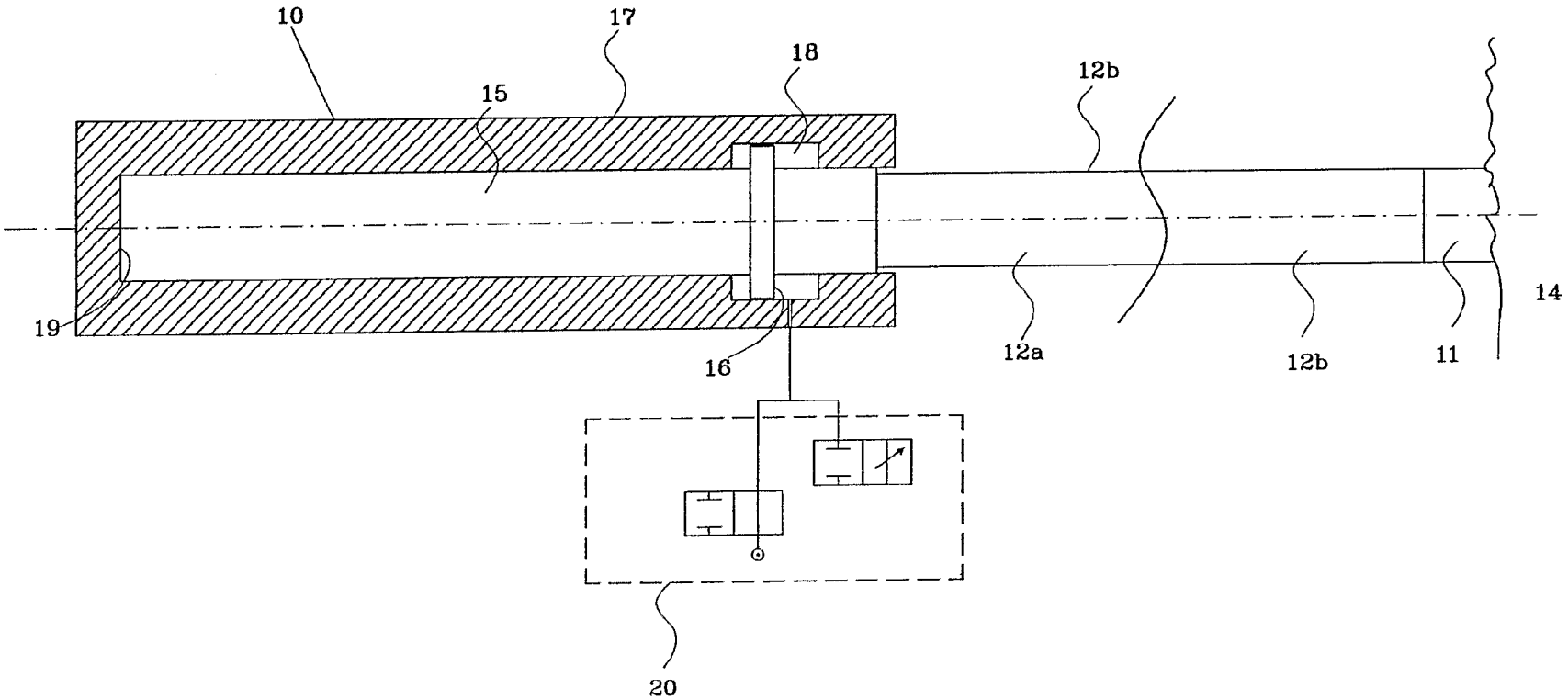
FIG. 1 shows a schematic cross section of a control device for an impulse-generating device according to a preferred embodiment of the present invention.

FIG. 1 shows an impulse-generating device 10 for a rock-drilling device that can advantageously be used with the present invention. During operation, the device 10 is connected to a drilling tool such as a drilling bit 11 via a drill string 12 consisting of one or more drill string components 12*a*, 12*b*. During drilling, energy in the form of shock waves is transferred to the drill string 12, and then from the drill string component 12*a* to the drill string component 12*b* and finally to the rock 14 via the drill bit 11, for breaking the rock 14.

In the device 10 illustrated, however, a piston that moves forward and backward is not used to generate the shock waves, but instead a loadable impact element in the form of an impact piston 15 is used, which is urged towards the end of a housing 17 that is opposite to the drill string 12 by the effect of a pressure medium acting against a pressure area 16. During operation, a chamber 18 is pressurized via a control valve 20 so that the pressure in the chamber 18 acts on the pressure area 16 and thereby urges the impact piston 15 towards the rear end 19 of the housing 17. The chamber 18 thus acts as a counter-pressure chamber.

Figure 2A:
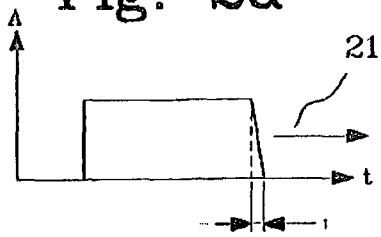
FIGS. 2*a*-2*e* show examples of shapes of shock waves and reflection waves.

In known technology, the control valve 20 is then opened suddenly to create an immediate reduction in pressure in the counter-pressure chamber 18, whereupon the impact piston 15 expands to its original length and transmits potential energy to the drill string 12 in the form of a shock wave. This sudden reduction in pressure generates a shock wave of essentially the same shape as a shock wave generated by a normal impact piston, that is a principally rectangular shape, with amplitude A, see FIG. 2*a*, which propagates in a propagation direction 21 through the drill string to the drill bit 11 for transmission to the rock 14. On account of the characteristics of the rock 14, however, all the energy of the shockwave cannot be taken up by the rock on account of the short rise time of the shock wave (see $\tau$ in FIG. 2*a*; in the figure, $\tau$ is exaggerated for the sake of clarity; $\tau$ can be considerably shorter, that is the edge can be considerably steeper), but instead a part of the provided energy is reflected and returned to the impulse-generating device 10 through the drill string 12, which has an adverse effect on the rock-drilling device and can cause wear of various components and serious damage as a result.

Figure 2D:
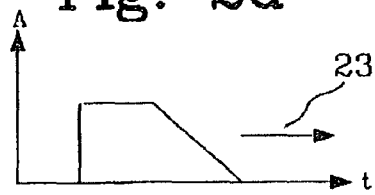
Figure 2B:
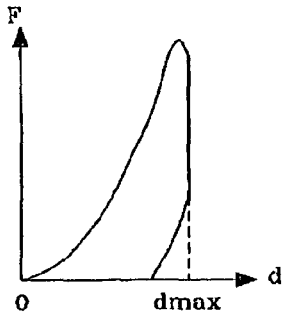

FIG. 2*b* shows an example of the penetrating force as a function of the penetration depth for an exemplary type of rock. As can be seen in the figure, the penetrating force that the drill bit can transmit to the rock is essentially zero at the moment of impact (d=0) and then increases exponentially with the penetration depth until the shock wave reaches its end and the penetration reaches its maximum ($d=d_{max}$) and there is accordingly no longer any energy for further penetration, after which the penetration force rapidly drops to zero and, as can be seen in the figure, the drill bit is moved backward slightly by the elasticity of the rock and/or by reflection.

Figure 2E:
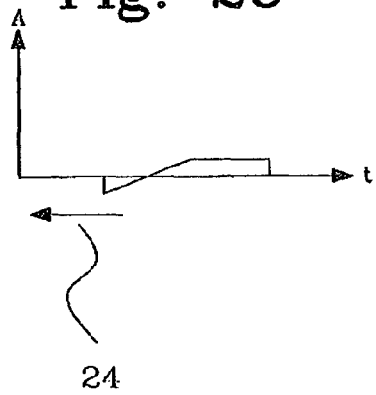
Figure 2C:
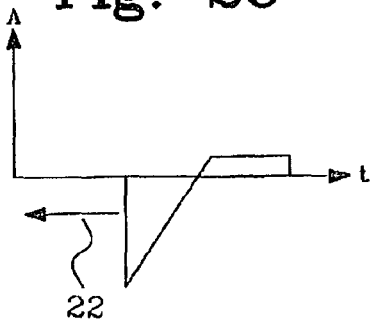

The curve of the reflection wave can be obtained in a simple way by subtracting the penetration curve from the shock wave curve. FIG. 2*c* shows the appearance of the reflection curve moving in direction 22 for the device according to known technology. As the penetration force of the drill bit is zero or essentially zero at the moment of impact, the amplitude A of the reflection wave at this moment will, in principle, correspond to the amplitude of the shock wave. If the edge of the shock wave is very steep, as in FIG. 2*a*, this thus means that the reflection wave will have a very high and hence harmful initial amplitude.

By means of the control valve 20 according to the invention that is shown in FIG. 1, these harmful reflections can, however, be reduced considerably. Instead of the reduction in pressure taking place suddenly, the opening of the control valve 20 in the device 10 shown can be controlled, that is the control valve 20 can control the reduction of pressure in the counter-pressure chamber 18. By controlling the opening of the control valve 20, the rise time of the shock wave induced in the drill string and hence in the drill bit, can be controlled. This is very advantageous, as the force which the drill bit can transmit to the rock varies with the depth of penetration of the drill bit, as shown above. FIG. 2*d* shows an example of a shock wave, moving in direction 23, according to the present invention. As shown in the figure, the edge of the shock wave is considerably less steep in comparison with the shock wave in FIG. 2*a*, for which reason, as shown in FIG. 2*e*, the amplitude A of the reflection wave, moving in direction 24, is considerably lower in comparison with the known technology, and hence less harmful to the rock-drilling device. In the ideal case, the rise time of the edge is precisely as long as the time that it takes for the drill bit to achieve maximal penetration. This time naturally varies, depending upon the type of rock that is being drilled, but if the type of rock is known, this knowledge can be used to select the rise time of the edge. The opening and closing of the control valve 20 is preferably controlled by a computer, and selection of operational data can, for example, be carried out by an operator entering suitable data into the control system of the drilling machine. Alternatively, the drilling machine can be provided with means for measuring/calculating the drilling rate automatically, and calculating the penetration time, and hence a desired value for the rise time of the edge, on the basis of these values.

Figure 3A:
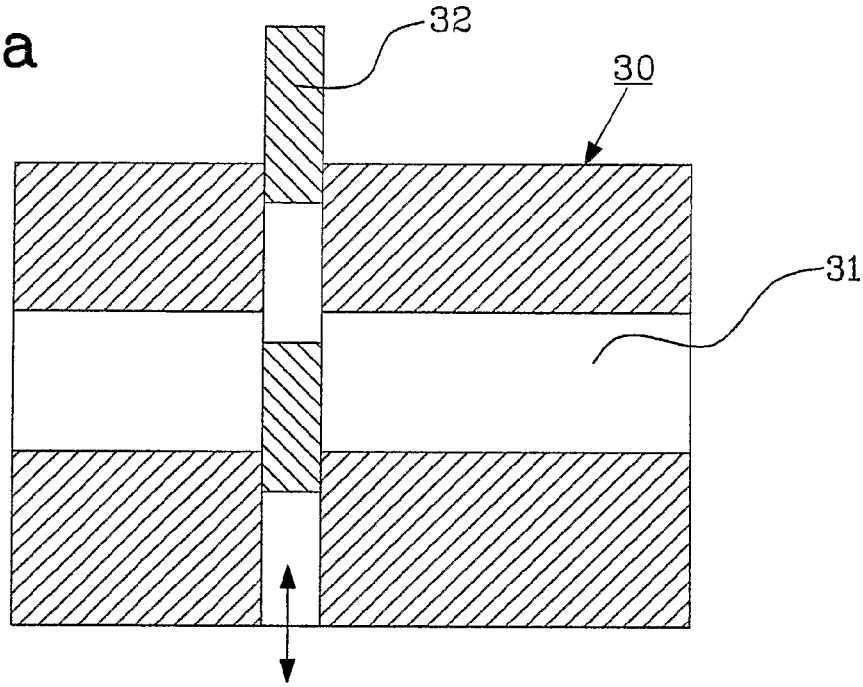
FIGS. 3*a-c* show an example of a control device according to the present invention.
Figure 3B:
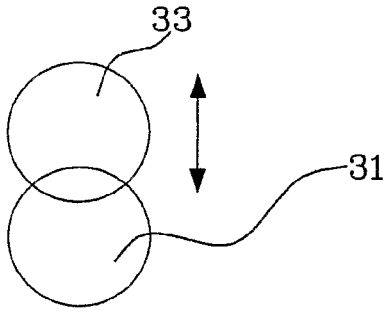
Figure 3C:
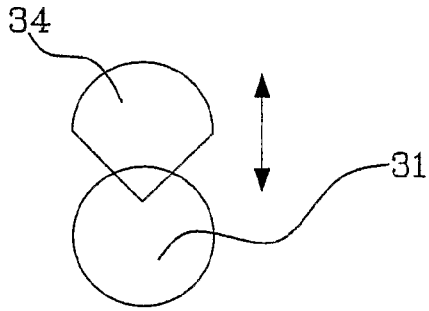

In an exemplary embodiment, the control valve 20 can act as a throttle valve, and can be arranged to directly control the opening by means of a controlled throttling. In an embodiment that is shown schematically in FIGS. 3*a-c*, the control valve 30 is designed as a throttle valve where the opening area in a main channel 31 can be freely controlled. FIG. 3*a* shows the valve from the side, in a partially-opened state, where the left side of the main channel 31 is connected to the counter-pressure chamber 18 and the right side of the main channel 31 is connected to a reservoir (not shown). By controlling a throttle slide 32, the required opening area can be obtained, and the reduction in pressure in the counter-pressure chamber 18 can thereby be regulated by regulating the flow. FIGS. 3*b* and 3*c* show examples of how the opening area of the throttle slide can be designed. In both figures, the area of the main channel 31 is circular, while in FIG. 3*b* the opening 33 of the throttle slide is also circular and in FIG. 3*c* approximately half of the opening 34 of the throttle slide is circular and approximately half is triangular. This design allows precise regulation of even very small flows. By regulating the movements of the throttle slide, the edge of the shock wave can be shaped precisely as required. By closing the valve at a particular remaining pressure in the counter-pressure chamber 18, the length of the shock wave can also be controlled by generating a shock wave with a lower amplitude (that is keeping the pressure in the chamber at a constant level, for example a quarter or a half of the initial pressure).

Figure 4A:
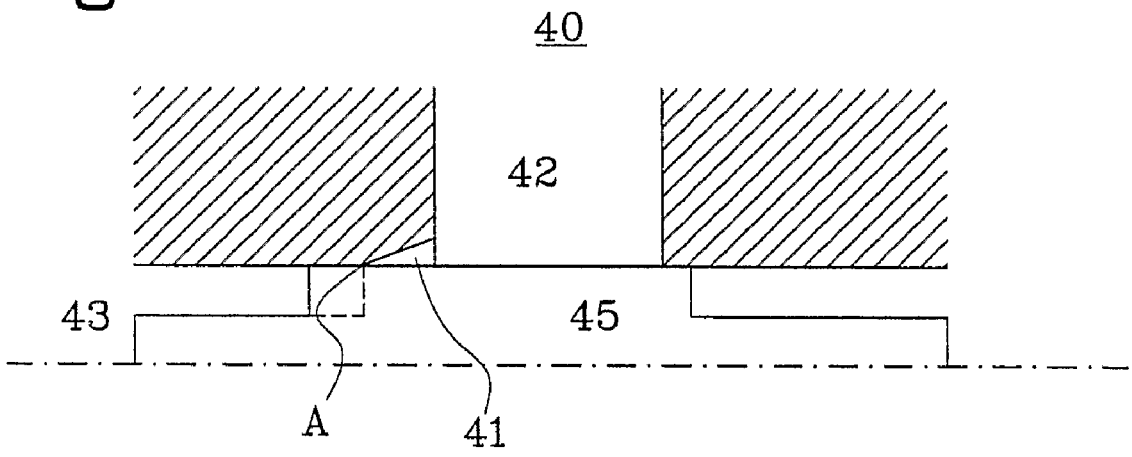
FIGS. 4*a-b* show another example of a control device according to the present invention.
Figure 4B:
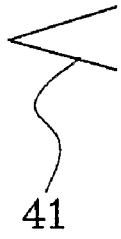

In an alternative embodiment, shown schematically in FIGS. 4*a*-4*b*, the control valve 40 is provided with a pressure-reducing notch 41 in order to obtain a smooth regulation of the pressure. FIG. 4*a* shows the control valve 40 from the side and FIG. 4*b* shows the notch from below. The control valve 40 has an inlet 42 for connection to the pressure-reducing chamber 18 and an outlet 43 that leads to a reservoir (not shown). In addition, the valve is provided with a valve slide 45 for opening and closing the valve 40. In FIG. 4*a*, the valve is shown in its closed position, and when the valve is to be opened for the generation of a shock wave, the slide 45 is moved to the right in the figure. When the valve reaches the position A (indicated by broken lines), the pressure medium in the counter-pressure chamber 18 starts to be released to the reservoir via the pressure-reducing notch 41 in the valve housing 46. As can be seen in FIG. 4*b*, a very small opening area is obtained first, which then becomes larger and larger the further the slide is moved to the right. How quickly the channel opens can be controlled in a simple way by the use of the notch 41. By adapting the shape of the notch, the required opening can be obtained in a simple way. The notch also enables very good control to be achieved by means of small movements. By regulating the movements of the slide, the edge of the shock wave can be shaped precisely as required. It is also possible here to close the valve at a particular remaining pressure in the counter-pressure chamber, in order to control the length of the shock wave.

Instead of a single pressure-reducing notch 41 being used, it is of course also possible for several pressure-reducing notches to be used. It will be recognized by an expert in the field that the one or more notches can alternatively be arranged on the valve slide 45. As yet another alternative, both the slide 45 and the valve housing 46 can be provided with notches.

Even though the throttling described above means that energy is wasted by the throttling, this wasted energy consists mostly of "harmful energy", for which reason, with correct throttling, the performance of the rock-drilling device is only affected adversely to a very small extent or not at all.

Figure 5:
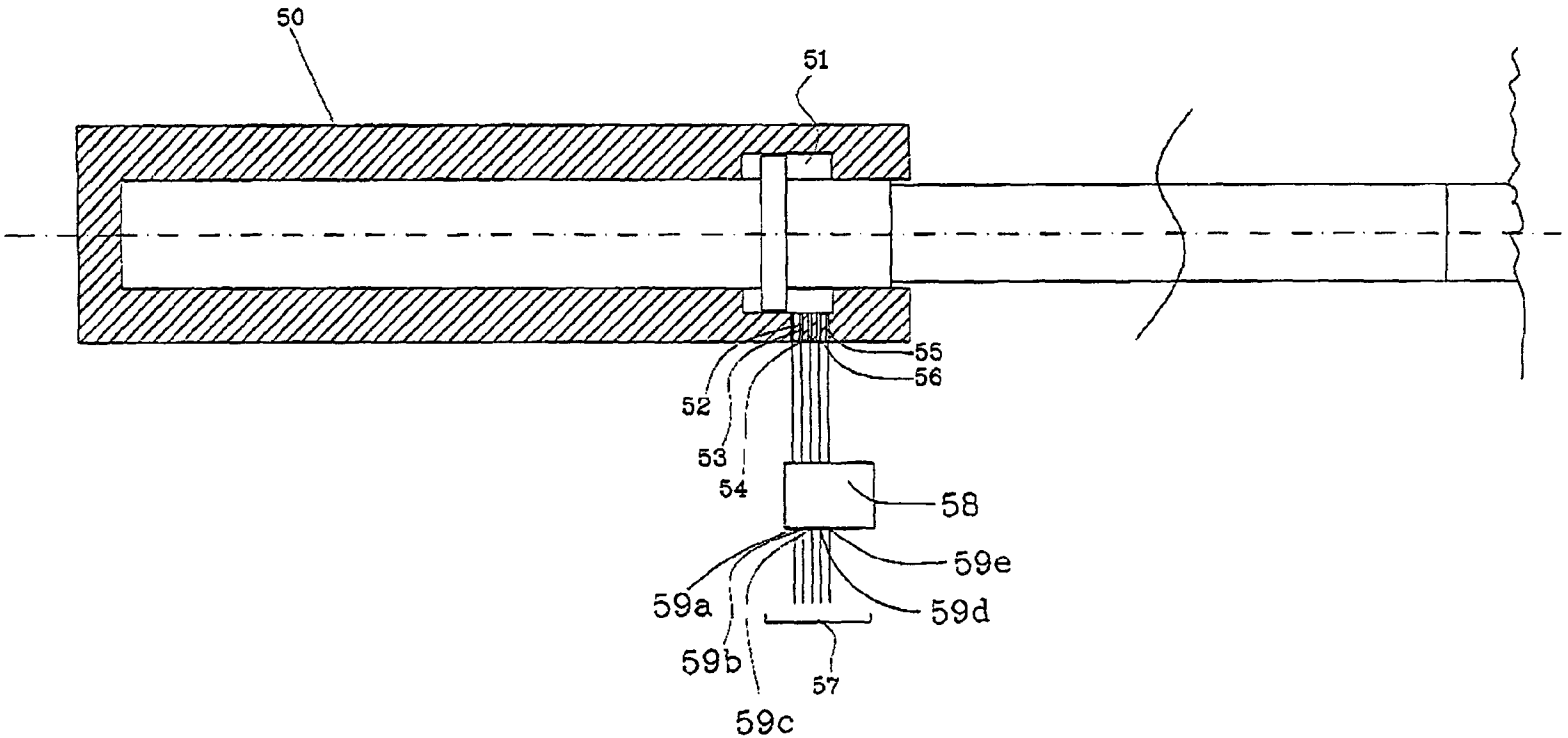
FIG. 5 shows an additional example of a control device according to the present invention.

FIG. 5 shows yet another alternative embodiment of an impulse-generating device 50 according to the present invention. As described above, the counter-pressure chamber is pressurized in the way described above, but the reduction in pressure is regulated by means of a different type of control device 58 having a plurality of openings designated by reference number 59*a*, 59*b*, 59*c*, 59*d*, and 59*e*. The counter-pressure chamber 51 comprises a plurality of outlets (five in the embodiment illustrated, but this number can, of course, be varied freely from two upwards) 52-56 that have a relatively small diameter. The opening of the outlets 52-56 can be controlled, whereby said reduction in pressure can be regulated by opening and closing suitable outlets 52-56. In the example illustrated, all the outlets have the same diameter, but the outlets can, of course, have different diameters. The different outlets 52-56 are connected to an essentially non-pressurized reservoir 57 and, by means of a suitable choice of diameters, the outlets 52-56 act as throttles, whereby a discrete regulation of the pressure can be obtained by opening the outlets sequentially or by combining sequential opening and opening in parallel.

Figure 6:
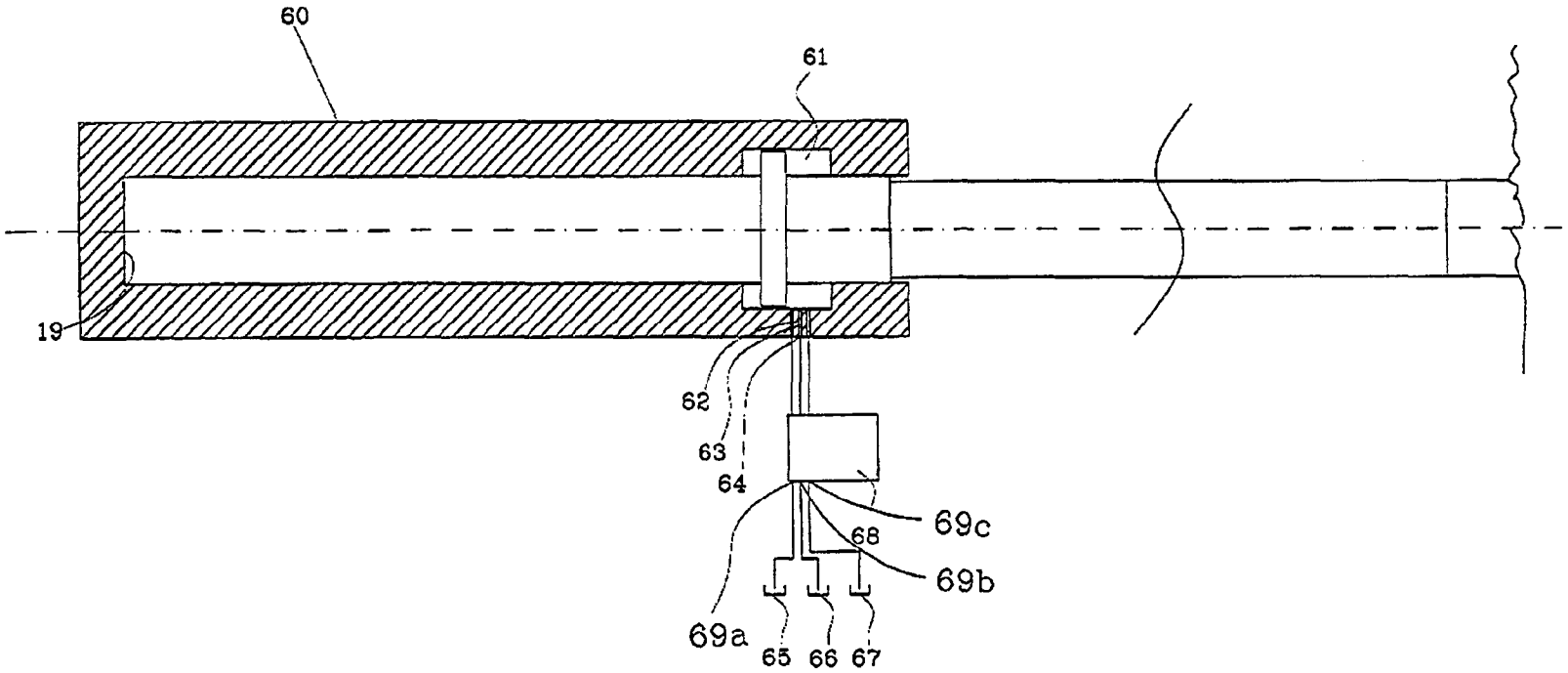
FIG. 6 shows yet another example of a control device according to the present invention.

FIG. 6 shows yet another alternative embodiment of a control device 68 having a plurality of openings designated by reference numerals 69*a*, 69*b*, and 69*c*, according to the present invention.

Precisely as in FIG. 5, the counter-pressure chamber 61 is provided with a number of outlets 62-64, but instead of being connected to a non-pressurized reservoir, these are each connected to a pressurized reservoir 65-67 respectively, with each reservoir 65-67 being pressurized to different pressures, and with all the pressures being lower than the corresponding pressure in a pressurized counter-pressure chamber. By opening the outlets 62-64 in stages, with the outlet 62 to the pressure reservoir 65 that has the highest pressure being opened first, a stepped shock wave edge is obtained. Depending upon the choice of the number of outlets and reservoirs and the diameter of the outlets, a continually or practically continually rising edge can also be obtained. This solution has the advantage that no energy is consumed by conversion to heat in a throttle process, as this energy is transferred in principle without loss to the pressurized reservoirs 65-67. The length of the flow path between the respective outlets and reservoirs can be regulated.

FIGS. 7*a*-7*d* show alternative embodiments of impulse-generating devices that can advantageously be used together with the present invention.

Figure 7A:
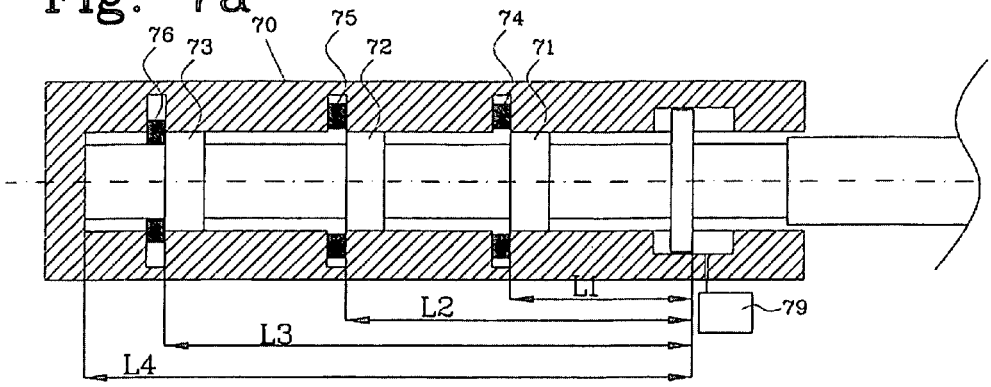
FIGS. 7*a-d* show examples of different impulse-generating devices that can be used together with the present invention.

FIG. 7*a* shows an impulse-generating device 70 with, in principle, the same function as the device 10 in FIG. 1, but where it is possible to regulate how great a length of the impact piston is to be loaded. This is achieved by the impact piston being provided with flanges 71-73 behind which clamps 74-76 can be tightened in order to load a selected length of the impact piston lengths L1-L4. In addition to the adjusting capability provided by the present invention, this embodiment thus also makes it possible to set the length of the shock wave in a way that does not affect the proportion of the energy that is wasted.

Figure 7B:
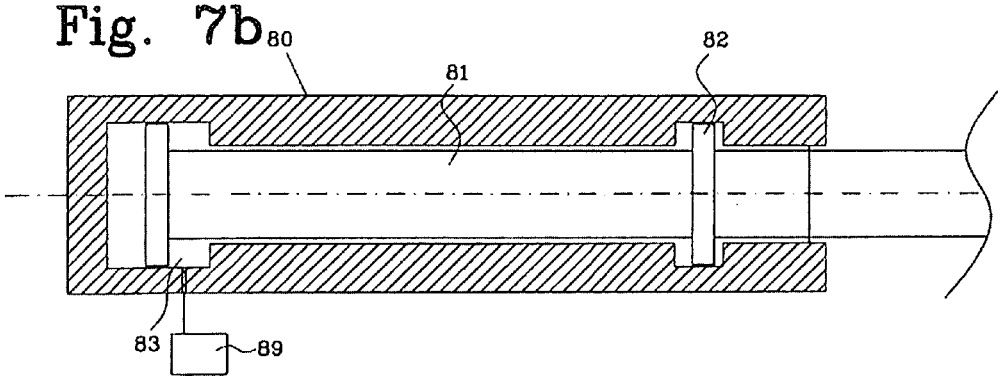

FIG. 7*b* shows an impulse-generating device 80, that also has, in principle, the same function as the device 10 in FIG. 1, but where the impact piston 81 is subjected to a tensile stress instead of a compressive stress. The movement of the impact piston 81 is limited by a flange 82 and it is loaded by pressurization of a chamber 83. The chamber 83 functions precisely as the counter-pressure chamber 18 in FIG. 1 and by regulation of the reduction in pressure in the chamber, the shape of the shock wave can be regulated as described above.

Figure 7C:
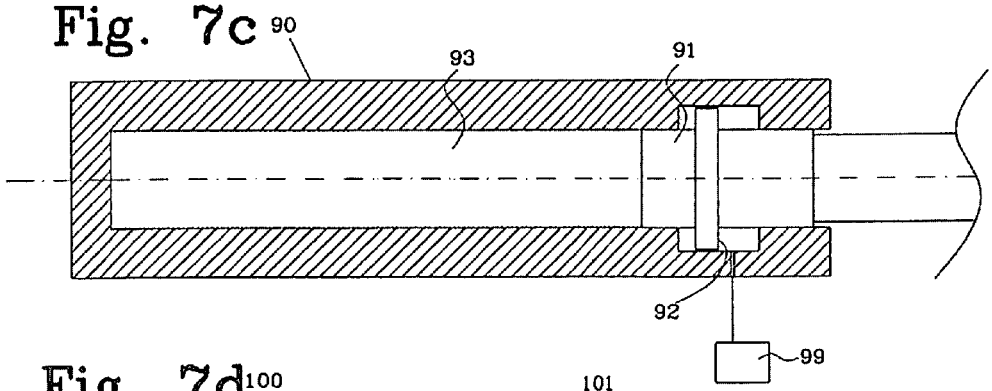

FIG. 7*c* shows an impulse-generating device 90 that functions completely in accordance with FIG. 1, but where a pressure area 92 on the impact piston 91 is used to compress a compressible material 93 instead of loading the impact piston 91.

Figure 7D:
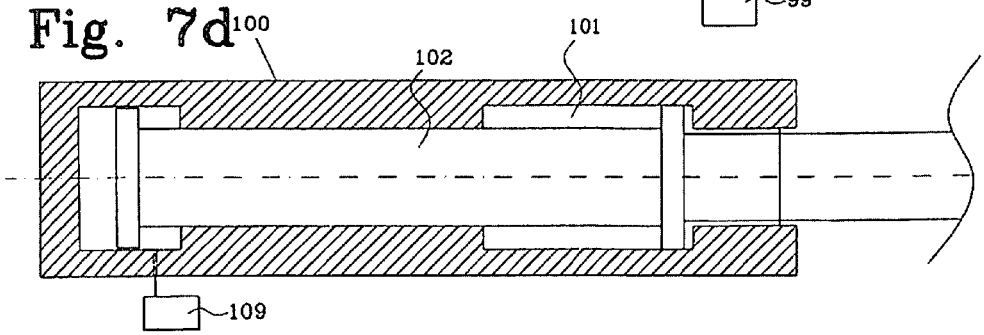

FIG. 7*d* shows an impulse-generating device 100 similar to that in FIG. 7*b*, but where a compressible material 101 is compressed instead of the impact piston 102 being subjected to a tensile stress.

The control device for regulating the pressure reduction within the devices illustrated by FIGS. 7*a*-7*d* are designated by reference numerals 79, 89, 99, and 109, respectively.

The devices described above can also be provided with means for increasing still further the pressure in the respective counter-pressure chambers, after the pressurization of the chambers has been terminated.

This can, for example, be achieved by reducing the volume of the counter-pressure chamber by means of a pressure-increasing piston, which reduction in volume increases the pressure in the counter-pressure chamber. The pressure-increasing piston can also be used to increase still further the pressure in the compressible material in FIGS. 7*c* and 7*d*. In the device shown in FIG. 7*c*, a screw arrangement can also be used to increase still further the pressure of the compressible material by reducing the volume occupied by the compressible material by means of the screw arrangement, which thereby also increases the pressure in the counter-pressure chamber.

These ways of increasing still further the pressure in the counter-pressure chamber have the advantage that a greater shock wave amplitude can be obtained, and hence a greater freedom of choice in the shape of the shock wave.

A plurality of examples of suitable impulse-generating devices for which the present invention is applicable have been described in the above description, but, as will be recognized by an expert in the field, the present invention can, of course, be used with any impulse-generating device where a reduction in pressure in one (or more) counter-pressure chambers is used to generate a shock wave.

Only percussive drilling has been mentioned in the above description. This percussive drilling can, however, of course be combined with a rotation of the drill strings in the usual way for the purpose of achieving drilling where the drill elements of the drill bit encounters new rock at each stroke (that is, does not make contact in a hole that has been made by the previous impact). This increases the efficiency of the drilling.

The invention claimed is:

1. Control device for an impulse-generating device for inducing a shock wave in a tool, in which said impulse-generating device comprises an impact element for transmitting said shock wave to said tool, a counter-pressure chamber acting against the impact element and a device for reducing a pressure in the counter-pressure chamber, characterized in that the control device comprises control means for regulating the reduction of the pressure in said counter-pressure chamber to avoid sudden or abrupt reduction of the pressure in said counter-pressure chamber without directly affecting a frequency at which the shock waves are being generated.

2. Device according to claim 1, characterized in that the means for reducing the pressure includes a control valve for connection to said counter-pressure chamber, which control valve comprises at least one opening for controlling said reduction of the pressure by release of pressure medium contained in the counter-pressure chamber during operation.

3. Device according to claim 2, in which said control means comprises means for controlling said reduction in pressure by controlling the at least one opening of the control valve.

4. Device according to claim 3, in which said means comprises control of an opening area of the control valve.

5. Device according to claim 3, in which the control valve is designed with pressure-reducing notches for regulating said reduction in pressure.

6. Device according to claim 3, characterized in that the control valve comprises a plurality of openings.

7. Device according to claim 2, in which the control valve is designed with pressure-reducing notches for regulating said reduction in pressure.

8. Device according to claim 2, characterized in that the control valve comprises a plurality of openings.

9. Device according to claim 1, in which said counter-pressure chamber comprises a plurality of outlets, which said outlets can be opened in a controlled way, and in which said reduction in pressure can be regulated by opening and closing suitable outlets of said plurality of outlets.

10. Device according to claim 9, in which said outlets have different diameters.

11. Device according to claim 10, characterized in that said outlets are connected to one or more reservoirs by means of one or more flow paths, which said one or more reservoirs are able to be pressurized to different pressures during operation, whereby at least one of a stepped and continual reduction in pressure in the counter-pressure chamber can be obtained by opening said outlets.

12. Device according to claim 9, characterized in that said outlets are connected to one or more reservoirs by means of one or more flow paths, which said reservoirs are able to be pressurized to different pressures during operation, whereby a stepped and/or continual reduction in pressure in the counter-pressure chamber can be obtained by opening said outlets.

13. Device according to claim 12, characterized in that each of the flow paths defines a length, and the length of said flow paths is regulated.

14. Device according to claim 1, characterized in that said control device comprises means for controlling said reduction in pressure by the regulation of a throttle valve intended to be connected to the counter-pressure chamber.

15. Impulse-generating device for inducing a shock wave in a tool, which said impulse-generating device comprises an impact element for transmitting said shock wave to said tool, which said shock wave is emitted by reducing the pressure in a counter-pressure chamber acting against the impact element, characterized in that the device comprises a control device according to claim 1.

16. Device according to claim 15, which device comprises, in addition, means for putting the impact element in a loaded state, whereby a reduction in the pressure in the counter-pressure chamber releases the impact element from the loaded state, whereupon potential energy that is stored in the impact element is emitted in the form of a shock wave in a direction towards the tool.

17. Device according to claim 16, in which said means for putting the impact element in the loaded state consists of said counter-pressure chamber.

18. Drilling rig, characterized in that the drilling rig includes a control device according to claim 1.

19. Method for an impulse-generating device for inducing a shock wave in a tool, which said impulse-generating device comprises an impact element for transmitting said shock wave to said tool, a counter-pressure chamber acting against the impact element, and means for reducing a pressure in the counter-pressure chamber, which method comprises the step of: regulating the reduction of the pressure in said counter-pressure chamber thereby avoiding sudden or abrupt reduction of the pressure in said counter-pressure chamber.

* * * * *